United States Patent [19]

Wade

[11] 4,143,789

[45] Mar. 13, 1979

[54] RETAINER FOR RELEASABLE SECUREMENT OF DRUMS AND SEALING CAPS

[75] Inventor: Don W. Wade, Orinda, Calif.

[73] Assignee: Rheem Manufacturing Company, New York, N.Y.

[21] Appl. No.: 900,075

[22] Filed: Apr. 26, 1978

[51] Int. Cl.[2] ..... B65D 45/28

[52] U.S. Cl. ..... 220/323; 220/214

[58] Field of Search ..... 220/214, 243, 256, 315, 220/323, 324

[56] References Cited

U.S. PATENT DOCUMENTS

| | | | |
|---|---|---|---|
| 2,777,125 | 1/1957 | Weisse | 220/323 |
| 3,913,779 | 10/1975 | Blazer et al. | 220/243 |

*Primary Examiner*—George T. Hall

*Attorney, Agent, or Firm*—Watson, Leavenworth, Kelton & Taggart

[57] ABSTRACT

The sealing cap of a packaging drum is retained in releasable assembly with the drum, during empty transport condition, by a retainer which functions in first part to restrain movement of the retainer and the sealing cap axially of the neck of the drum and in second part to restrain movement of the retainer transversely of the neck.

9 Claims, 4 Drawing Figures

RETAINER FOR RELEASABLE SECUREMENT OF DRUMS AND SEALING CAPS

FIELD OF THE INVENTION

This invention relates generally to packaging drums and pertains more particularly to releasable retention of sealing caps to such drums during shipment thereof to a packaging user.

BACKGROUND OF THE INVENTION

In transporting packaging drums to food processing users, the container industry has typically transported the shipping container separately from its metal sealing cap, relying on a plastic dust cap installed in the drum fill opening for anticontaminant protection in the course of drum shipment. At the user location, the protective cap is removed, the drum is filled and the metal cap retrieved from its separate shipment box and installed in the fill opening, curled flanges of the sealing cap and fill opening neck then being jointly crimped to ready the packaged drum for shipment to a consumer.

Apart from the inconvenience to the container manufacturer in separately shipping the sealing caps and the inconvenience to the food processing user in monitoring the separate shipments of drums and sealing caps, this customary practice has had the further disadvantage of the plastic caps occasionally being pushed through the fill opening into the container interior. In the instance of food packaging, the container is rendered unsuitable for use on these incidences unless the dust cap is removed from the container interior.

While the foregoing situation has given rise to the desire for transporting the packaging drum and its metal sealing cap to the user as a releasably secured assembly and desired elimination of the protective plastic dust cap, no expeditious solution to the problem is presently practiced.

SUMMARY OF THE INVENTION

It is the object of the present invention to provide retention structure enabling such shipment of a packaging drum and sealing cap as a releasably secured assembly.

In attaining this and other objects, the invention provides a retention device readily applicable to a releasable assembly of drum and sealing cap and having structural components compatible with structural features of both the drum and sealing cap to provide a releasable interlock thereof effective during shipment. While exhibiting such ready applicability and ease of releasability, the retention device provides its desired effect in manner holding the sealing cap sufficiently tight with the drum to prevent dust from gaining access to the drum interior and yet sufficiently loose to allow the drum to breathe, thus offsetting the possibility of establishing objectionable vacuum in the drum interior.

The foregoing and other objects and features of the invention will be further understood from the following detailed description of the preferred embodiment thereof and from the drawings wherein like reference numerals identify like parts throughout.

DESCRIPTION OF THE PREFERRED EMBODIMENT

Figure 1:
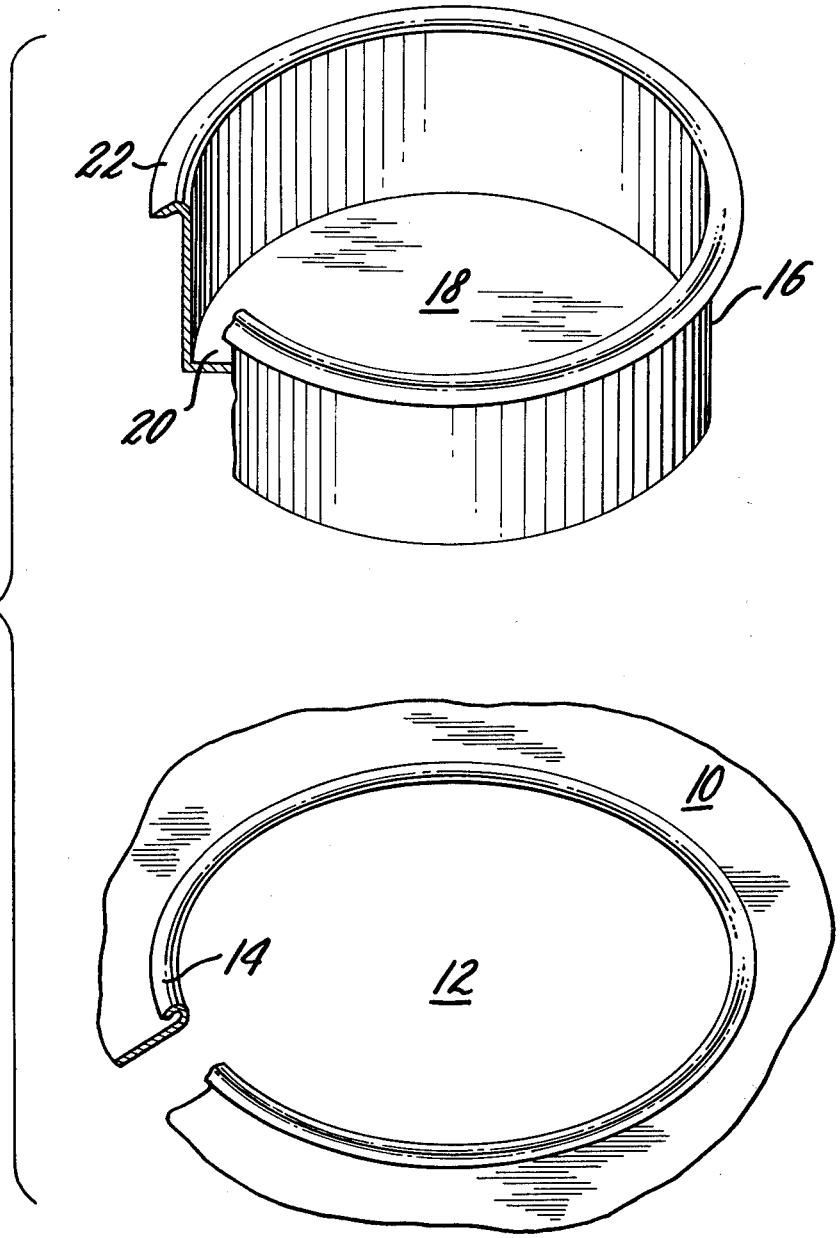
FIG. 1 is a perspective exploded view illustrating a portion of the top head of a shipping drum, having a curled filler neck defining its fill opening, and a sealing cap therefor having a flange jointly crimpable with the neck curl for drum closure.

Referring to FIG. 1, metal container top head 10 is of conventional design, having a peripheral flange (not shown) which is rolled with a companion flange on the customary open-headed metal container to form the well known packaging drum in extensive industrial use in the above-noted food packaging and other applications. Fill opening 12 is situated in top head 10, being bounded by cylindrical neck 14 integrally formd with top head 10 and peripherally curled radially outwardly of neck 14, as indicated in a broken-away portion of FIG. 1.

The closure member 16 for opening 12 is generally in the form of a sealing cap having a recess 18 extending axially of neck 12 to base 20 and a peripheral curl 22 extending radially outwardly of recess 18 and of similar configuration to the neck curl. Member 16 may include sealing gasket **22*a* (FIG. 4), which may be comprised of latex or like material flowed into curl 22. After filling of the drum, the sealing cap is seated in opening 12** and the cap and neck curls are joined to seal the drum for shipping thereof.

Figure 2:
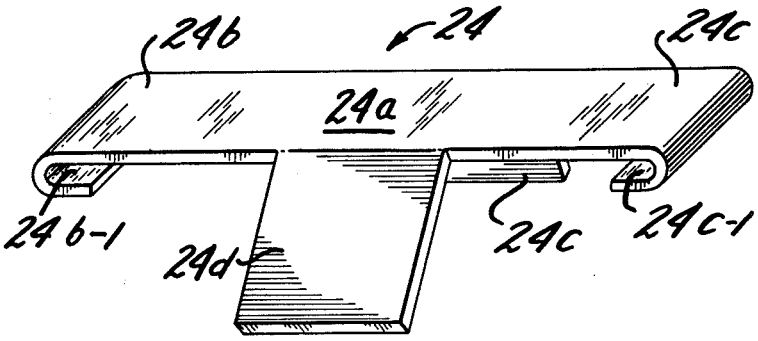
FIG. 2 is a perspective view of a securement device constructed in accordance with the invention.

Retainer 24, shown in FIG. 2, is of molded, semi-rigid polypropylene construction, and includes a central land **24*a*, the plane of which is common with that of purchase arms 24*b* and 24*c*, which have reduced thickness ends 24*b*-1 and 24*c*-1 curled and legged under. These ends of arms 24*b* and 24*c* are spaced from one another about the periphery of retainer 24 and are opposingly spaced from one another by a measure which is at least the outer diameter of the curl 22 of cap 16, for purposes discussed below. Capture arms 24*d* and 24*e* extend from land 24*a* at common acute angle with respect to the plane of the land. The capture arms have flexure capability about such 1 and plane, as contrasted with purchase arms 24*b* and 24*c***.

Figure 3:
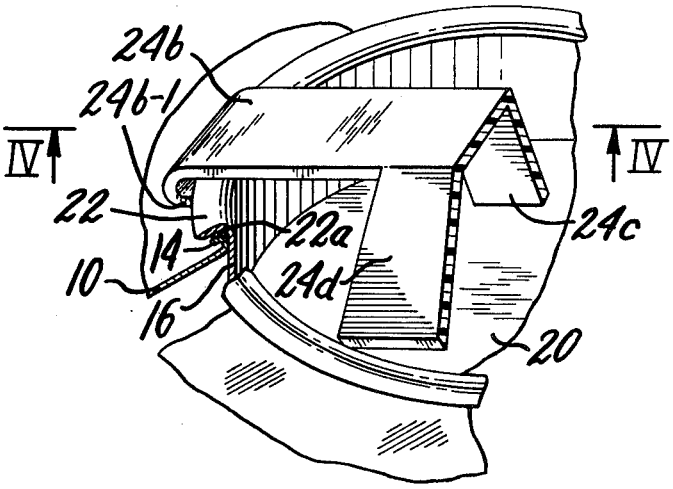
FIG. 3 is a partial perspective view illustrating the assembly reached in practice of the invention.
Figure 4:
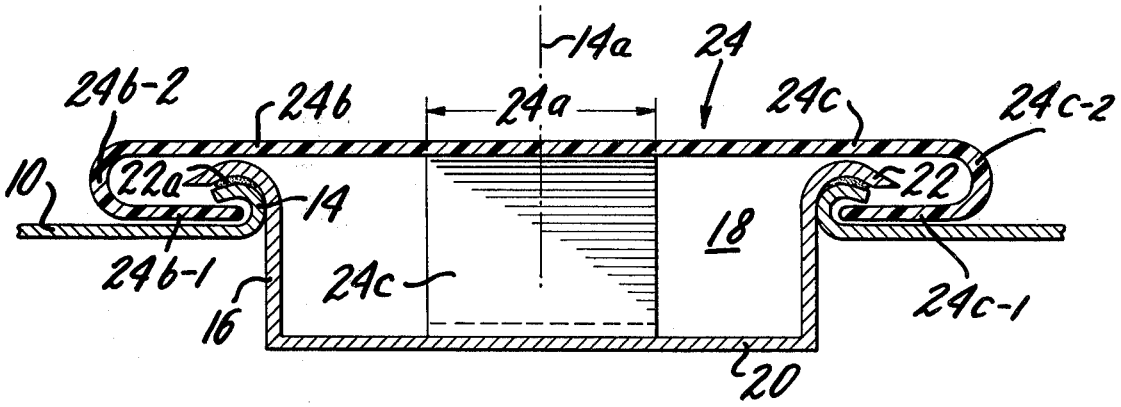
FIG. 4 is a sectional view of the FIG. 3 assembly as seen from plane IV—IV of FIG. 3.

FIGS. 3 and 4 show top head neck 14, cap 16 and retainer 24 in releasably secured assembly. Purchase arms **24*b* and 24*c* have their ends 24*b*-1 and 24*c*-1 situated adjacent the upper surface of top head 10 and within the curl of neck 14. Cap 16 is seated in neck 14 and purchase arms 24*b* and 24*c* overlie the cap, which accordingly is restrained, together with retainer 24, from movement axially of neck 14, i.e., along neck axis 14*a*. Capture arms 24*d* and 24*e* engage interior surfaces of cap 16 bonding recess 18, which surfaces are diametrically opposed portions of base 20** and adjacent cap vertical sidewall.

In reaching the assembly of FIGS. 3 and 4, cap 16 is seated in top head opening 12 and retainer 24 is moved in any path toward neck 14 with arm ends **24*b*-1 and 24*c*-1 closely adjacent the upper surface of top head 10 to advance beneath the curl of neck 14. The ends of these purchase arms are spaced peripherally, as noted above, by such measure as to provide free movement thereof into their FIG. 3 disposition. The purchase arm ends are diametrically spaced apart by at least the outer diameter of the neck curl and, preferably as in FIG. 4, extend to curved segments 24b-2 and 24c-2** substantially outboard of the arm ends for ease of assembly.

In the course of such advance of the retainer, the one of capture arms 24d and 24e in leading relation to neck 14 may be manipulatively flexed outwardly of the selected path into non-interfering relation with the releasably assembled neck and cap. As the leading capture arm passes over the cap curl, it is released and flexes into cap recess 18. Alternatively, the retainer may be positioned initially at such angle that the leading capture arm enters the cap recess in unflexed condition. On further advance of the retainer onto the assembled neck and cap, the trailing capture arm engages the cap curl and is flexed upwardly into the plane of land 24a and rides atop the cap curl until it is released therefrom to flex into recess 18. As this juncture, the assembly of FIGS. 3 and 4 is reached and the empty drum may be shipped unitarily with sealing cap.

To disassemble the assembly of FIGS. 3 and 4, either of capture arms 24d and 24e is flexed upwardly of recess 18 above the cap curl and the retainer is moved radially outwardly of neck 14 with such flexed capture arm leading in the direction of movement. As arm ends 24b-1 and 24c-1 pass free of the neck curl, the retainer is freely withdrawn from the releasably assembled neck and cap and the cap is withdrawn for drum filling.

As will be appreciated, the depicted preferred retainer embodiment is but a single version of the invention, and other retainer structure realizing its purchase and capture functions may be reached without departing from the invention. The foregoing detailed discussion and the illustrated preferred embodiment are thus intended in an illustrative and not in a limiting sense. The true spirit and scope of the invention is set forth in the following claims.

What is claimed is:

1. A retainer for releasable securement of a container, having a neck defining a container opening, and a closure member seated in said opening, comprising:

(a) first means engageable with said neck for restraining both said closure member and said retainer from movement axially of said neck; and (b) second means connected to said first means and engageable with the outer surface of said closure member for restraining said retainer from movement transversely of said neck for transverse forces of one sense and of the opposite sense applied to said retainer.

2. A retainer for releasable securment of a container, having a neck defining a container opening, and a closure member seated in said opening, comprising:

(a) first means engageable with said neck for restraining both said closure member and said retainer from movement axially of said neck, said first means being engageable with said neck by movement of said first means in a preselected path; and (b) second means connected to said first means and engageable with said closure member for restraining said retainer from movement transversely of said neck, said second means being comprised of flexible means movable outwardly of said path into non-interfering relation with said neck to facilitate said movement of said first means, said flexible means being further movable inwardly of said path from such non-interfering relation with said neck into such engagement with said closure member.

3. A retainer for releasable securement of a container, having a neck in the form of a continuous peripheral curl defining a container opening, and a closure member seated in said opening, comprising:

(a) first means engageable with said neck for restraining both said closure member and said retainer from movement axially of said neck, said first means comprising peripherally spaced portions having curl configuration opposite the configuration of said neck curl and engageable with said neck curl for such restrainment of both said closure member and said retainer member from movement axially of said neck; and (b) second means connected to said first means and engageable with said closure member for restraining said retainer from movement transversely of said neck.

4. A retainer for releasable securement of a container, having a neck defining a container opening, and a closure member seated in said opening and defining a recess extending axially with said neck and interiorly thereof, comprising:

(a) first means engageable with said neck for restraining both said closure member and said retainer from movement axially of said neck; and (b) second means connected to said first means and engageable with said closure member for restraining said retainer from movement transversely of said neck, said second means comprising flexible means movable axially interiorly of said closure member recess for such restraining of said retainer from movement transversely of said neck.

5. The retainer claimed in claim 3 wherein said neck is cylindrical and said neck curl is circular, said retainer first means portions being spaced diametrically from one another by a measure of at least the diameter of such neck curl.

6. The retainer claimed in claim 5 wherein said retainer includes a member extending diametrically of said neck and overlying said closure member on such engagement of said retainer first means portions and said neck, said diametrically extending member being integral with said retainer first means portions.

7. The retainer claimed in claim 4 wherein said closure member recess is cylindrical, said flexible means comprising first and second flexible members movable into engagement with diametrically opposed surfaces of said closure member bounding said recess.

8. The retainer claimed in claim 4 wherein said neck defines a continuous peripheral curl and wherein said retainer first means includes a member extending transversely of such neck curl and having opposed curled ends each with curl configuration opposite the configuration of said neck curl and engageable with said neck curl, said flexible means being integral with said member.

9. The retainer claimed in claim 8 comprised throughout of polypropylene.

* * * * *